US011596579B2

(12) United States Patent
Behzadi

(10) Patent No.: US 11,596,579 B2
(45) Date of Patent: Mar. 7, 2023

(54) CARRIAGE WITH TIMER MECHANISM FOR HOLDING A CONTAINER

(71) Applicant: Amir Akbar Sadigh Behzadi, Canoga Park, CA (US)

(72) Inventor: Amir Akbar Sadigh Behzadi, Canoga Park, CA (US)

( * ) Notice: Subject to any disclaimer, the term of this patent is extended or adjusted under 35 U.S.C. 154(b) by 174 days.

(21) Appl. No.: 17/157,823

(22) Filed: Jan. 25, 2021

(65) Prior Publication Data

US 2022/0062110 A1 Mar. 3, 2022

Related U.S. Application Data

(60) Provisional application No. 63/074,341, filed on Sep. 3, 2020.

(51) Int. Cl.
*A61J 7/04* (2006.01)

(52) U.S. Cl.
CPC ..... *A61J 7/0445* (2015.05); *A61J 7/049* (2015.05)

(58) Field of Classification Search
CPC ..... A61J 7/0445; A61J 7/049; A61J 7/04
USPC ..... 221/15, 71, 27, 225, 72, 70; 128/203.15, 128/203.21, 200.14, 203.25
See application file for complete search history.

(56) References Cited

U.S. PATENT DOCUMENTS 4,748,600 A * 5/1988 Urquhart ..... A61J 7/0445 368/10
4,817,822 A * 4/1989 Rand ..... A61M 15/009 128/200.14
5,020,527 A * 6/1991 Dessertine ..... A61M 15/0065 128/200.14
5,198,628 A * 3/1993 Bitko ..... H01H 35/02 200/220
5,207,217 A * 5/1993 Cocozza ..... A61M 15/0033 128/203.15
5,284,133 A * 2/1994 Burns ..... A61M 15/0066 128/203.14
5,411,173 A * 5/1995 Weinstein ..... G01F 11/006 128/200.22
5,415,162 A * 5/1995 Casper ..... A61M 15/0035 128/203.12
5,457,293 A * 10/1995 Breed ..... H01H 35/147 200/61.51
5,544,647 A * 8/1996 Jewett ..... B05B 11/1073 128/200.23
5,564,414 A * 10/1996 Walker ..... A61M 15/0083 128/200.23
5,611,444 A * 3/1997 Garby ..... A61M 15/0068 116/318
5,751,661 A * 5/1998 Walters ..... A61J 7/0409 368/278
5,785,048 A * 7/1998 Koerner ..... G01G 1/24 128/200.23

(Continued)

*Primary Examiner* — Rakesh Kumar
(74) *Attorney, Agent, or Firm* — Trojan Law Offices

(57) ABSTRACT

An apparatus and method for holding a container comprising of a carriage and timing mechanism. The apparatus is comprised of a lever with at least two positions relative to the carriage, a timer, and a timer reset mechanism such that when the lever is in the first position, the timer will start counting time. When the lever is moved to the second position, the timer reset mechanism will modify the timer such as by resetting the amount of time that has been counted. The user thus knows how much time has passed since the user last changed the position of the lever.

13 Claims, 11 Drawing Sheets

(56) References Cited

U.S. PATENT DOCUMENTS 6,029,659 A * 2/2000 O'Connor ..... A61M 15/009 128/200.23
6,390,088 B1 * 5/2002 Nohl ..... A61M 15/009 128/200.14
6,518,523 B1 * 2/2003 Chou ..... H01H 35/141 200/61.51
6,595,389 B2 * 7/2003 Fuchs ..... B05B 11/108 222/38
6,601,729 B1 * 8/2003 Papp ..... B65D 83/0454 221/25
6,698,425 B1 * 3/2004 Widerstrom ..... A61M 15/0036 128/203.15
7,219,665 B1 * 5/2007 Braithwaite ..... A61M 15/0061 128/203.19
7,793,798 B2 * 9/2010 Stradella ..... G06M 1/045 128/200.23
8,408,208 B2 * 4/2013 Bacon ..... A61M 15/008 128/200.14
8,430,271 B2 * 4/2013 Poulard ..... A61M 15/0026 128/200.23
9,084,864 B1 * 7/2015 Schroeder ..... A61M 16/0816
9,460,265 B2 * 10/2016 Burrows ..... A61J 7/0436
9,468,729 B2 * 10/2016 Sutherland ..... A61M 15/0065
9,968,522 B2 5/2018 Sadigh Behzadi
2002/0066451 A1 * 6/2002 Davies ..... A61M 15/0068 128/203.15
2003/0089733 A1 * 5/2003 Cain ..... A61J 7/0481 222/23
2004/0182873 A1 * 9/2004 Baum ..... G07F 11/44 221/76
2004/0255936 A1 * 12/2004 Urbanus ..... A61M 15/008 128/200.23
2007/0062525 A1 * 3/2007 Bonney ..... A61M 15/009 128/203.15
2007/0138195 A1 * 6/2007 Anderson ..... B65D 83/0409 221/15
2008/0029536 A1 * 2/2008 Wang ..... B25J 19/022 221/210
2015/0095047 A1 * 4/2015 Burrows ..... A61J 7/0436 206/534
2018/0000693 A1 * 1/2018 Sadigh Behzadi ... A61J 7/0436
2022/0062110 A1 * 3/2022 Sadigh Behzadi ..... A61J 7/049

* cited by examiner

CARRIAGE WITH TIMER MECHANISM FOR HOLDING A CONTAINER

CROSS REFERENCE TO RELATED APPLICATION

The application claims priority to and benefit of U.S. Provisional Patent Application No. 63/074,341, filed on Sep. 3, 2020, the content of which is incorporated by reference in its entirety.

FIELD OF THE INVENTION

The present invention relates to a universal carriage for containers. In particular, the present invention relates to a universal carriage for a container having an integrated timing mechanism.

BACKGROUND OF THE INVENTION

Health products such as pharmaceuticals and supplements often require administration of dosages at specific time intervals. For example, some medications require daily administration, while others may require administration every two, four, or six hours. A frequent problem is that a patient cannot remember the last time a particular medication was administered. This may cause critical health issues because patients may take too little medication for it to be effective or patients may overdose by administering medication too frequently.

Issues regarding the timing of dosages is not unique to health products. For other products that are frequently administered into the human body, such as tobacco products like cigarettes, a consumer may want to track the time between dosages to regulate or reduce the product's usage.

The prior art includes timers integrated into specific containers such as pill bottles. But those types of timers are limited in utility. For example, a timer on a pill bottle is limited to use on the medicine bottle itself. The timer cannot be adapted to a mechanism that will work universally with other bottles or containers. Additionally, pill bottle timers typically automatically reset when a bottle cap is removed and thus cannot be integrated into another type of container.

Additionally, some timers are manual timers, which require a user to remember to manually reset the timer before or after each use. The flaw is that patients may forget to reset the timer, which renders the timer useless.

To minimize potential health risks, there is a need to incorporate the ability directly to monitor the usage of certain products that have multiple dosages per day. There is also a need for a timer that is integrated to a universal carriage for containers such that it works with containers and bottles of different shapes and sizes.

It is an object of the invention to provide a universal carriage to hold a container of different sizes and shapes.

It is an object of the invention to provide a universal carriage to hold a container with an integrated timer.

It is an object of the invention to provide a universal carriage to hold a container with an integrated timer that automatically resets upon removal of the container.

It is an object of the invention an integrated timer can be removed from one carriage and mounted to another carriage.

SUMMARY OF THE INVENTION

As shown in FIG. 2, the universal carriage is comprised of an integrated timer and carriage, which serves to secure a container. The container can be various sizes and shapes but is generally in the shape of a cylinder in the depicted embodiment.

The integrated timer is characterized by a lever and a timer. In some embodiments, the lever serves to lock in the container to the carriage so the container cannot be removed or accessed unless the timer is reset when the lever is pivoted away from the top of the container. Once pivoted away, the lever allows enough space such that the container can be opened or removed from the carriage.

The integrated timer also has a timer reset mechanism, which is comprised of a timer mechanism channel, gravity response member, and a timer reset switch. When the integrated timer is pivoted at a sufficient angle away from the carriage (at or about 45 degrees from the central vertical axis of the carriage in preferred embodiments), the gravity response member will move towards the timer reset switch. As shown in FIG. 10, the lever will be pivoted away from the top of the container, allowing removal of the container from the carriage and/or opening of the container.

When pivoting back to the horizontal position, the gravity response member will thus be pulled by gravity toward the timer reset switch (when the integrated timer is at or about 45 degrees from the central vertical axis of the carriage). The timer will be reset when the gravity response member comes into contact with and actuates the timer reset switch (shown in FIG. 10). The timer will give an indication of time. For example, the timer may display that the time is reset by showing the corresponding information on an LCD screen 104 (e.g., set back to "0").

When the integrated timer is positioned fully in the vertical position (as show in in FIG. 1), the gravity response member is not in contact with the timer reset switch as they will be physically separated by a timer reset notch. When the gravity response member is not in contact timer reset switch, the timer will operate. For example, in a preferred embodiment, the timer will count upwards by measuring hours and minutes (as displayed by an LCD screen 104) to track the last time the container was removed from the carriage.

DETAILED DESCRIPTION OF THE INVENTION

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and to fully convey the scope of the invention to those skilled in the art.

Figure 1:
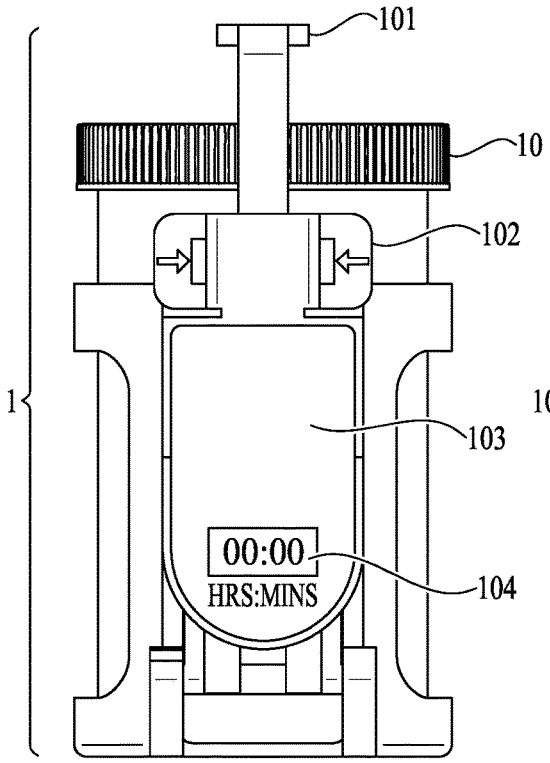
FIG. 1 is a back view of the universal carriage in accordance with an embodiment of the present invention.
Figure 12:
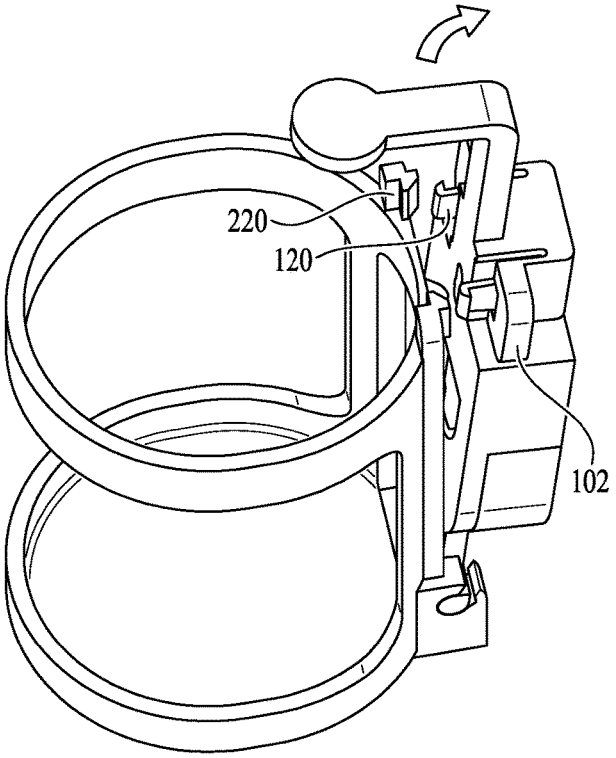
FIG. 12 is a top side perspective view of the universal carriage in accordance with an embodiment of the present invention without the container.

FIG. 1 depicts a universal carriage 1 according to an embodiment of the invention, which includes a container 10. FIG. 12 depicts the universal carriage 1 without the container 10.

Figure 2:
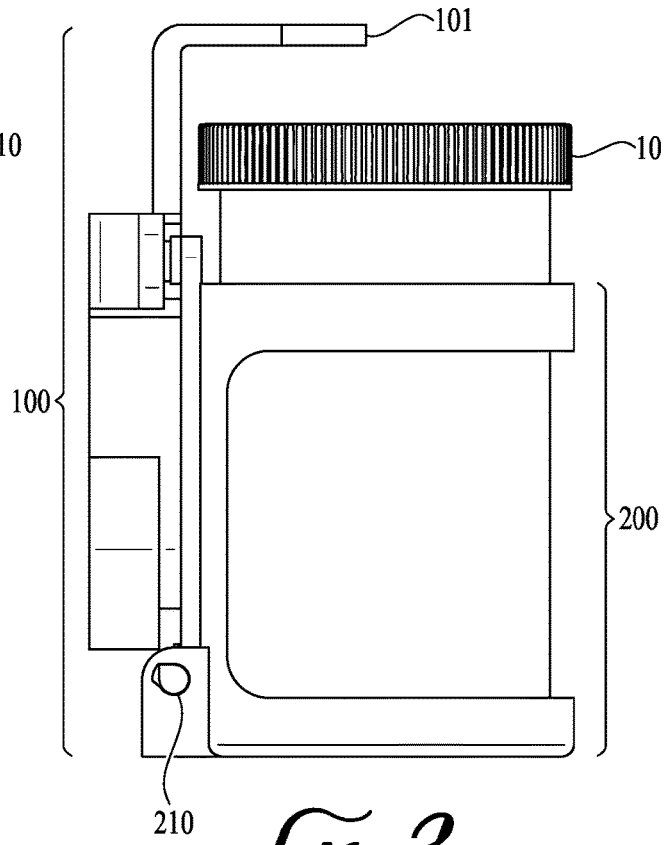
FIG. 2 is a side view of the universal carriage in accordance with an embodiment of the present invention.
Figure 21:
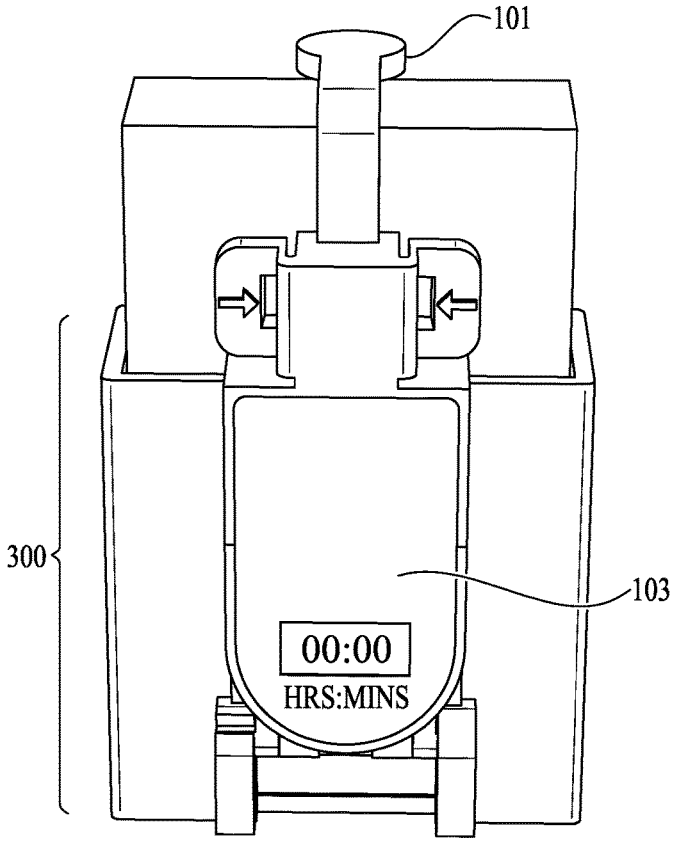
FIG. 21 is a back view of the universal carriage in accordance with an embodiment of the present invention with a rectangular carriage.
Figure 22:
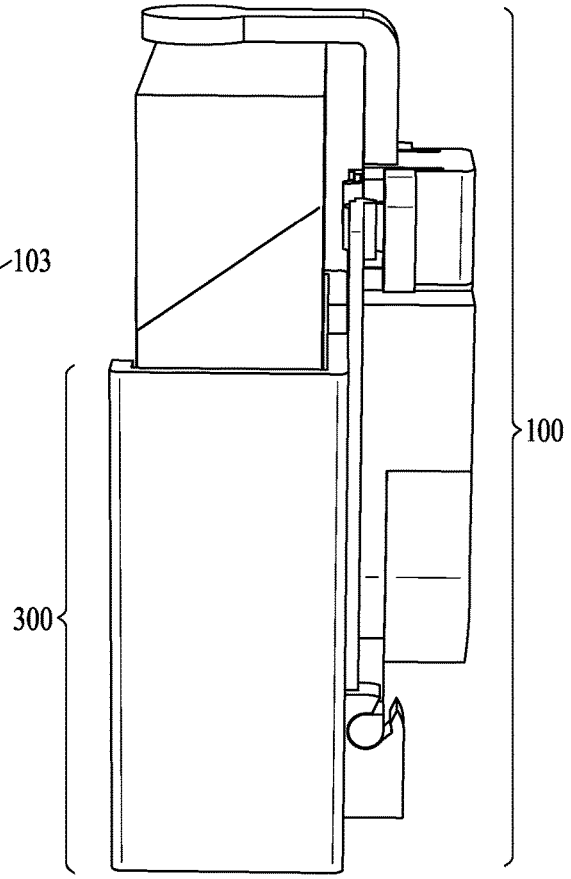
FIG. 22 is a side view of the universal carriage in accordance with an embodiment of the present invention with a rectangular carriage.

As shown in FIG. 2, the universal carriage 1 is comprised of an integrated timer 100 and carriage 200, which serves to secure a container 10. The container 10 can be various sizes and shapes but is generally in the shape of a cylinder. In other embodiments, the universal carriage 1 can be adapter to fit a rectangular container 10 as best shown in FIG. 21 or containers of various other shapes as known in the art.

A. General Description of the Integrated Timer

Referring to FIGS. 1 to 2, the integrated timer 100 is characterized by a lever 101 and a timer 103. In some embodiments, the lever 101 serves to lock in the container 10 to the carriage 200 so the container 10 cannot be removed or opened unless the timer 103 is reset when the lever 101 is pivoted away from the top of the container 10. Once pivoted away, the lever 101 allows enough space such that the container 10 can be opened and/or removed from the carriage 200. The lever 101 may be different heights to conform to containers of different sizes as exemplified in FIG. 19 or 20. One skilled in the art may include a lever 101 that is adjustable in height such that it can adjust a different size container 10.

Figure 11:
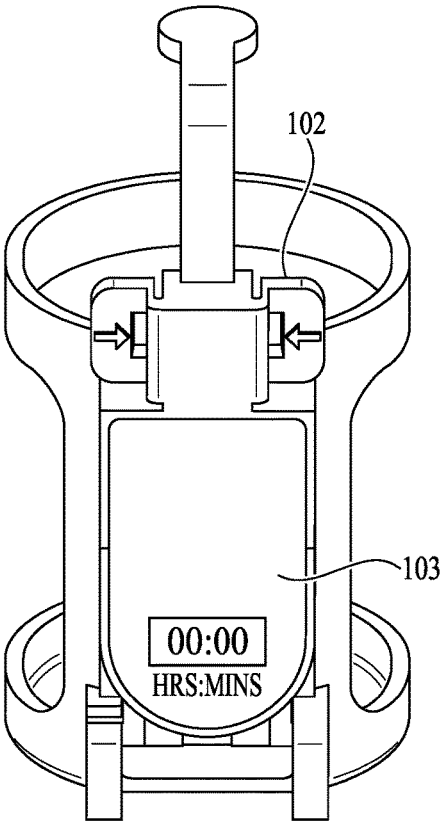
FIG. 11 is a back view of the universal carriage in accordance with an embodiment of the present invention without the container.
Figure 13:
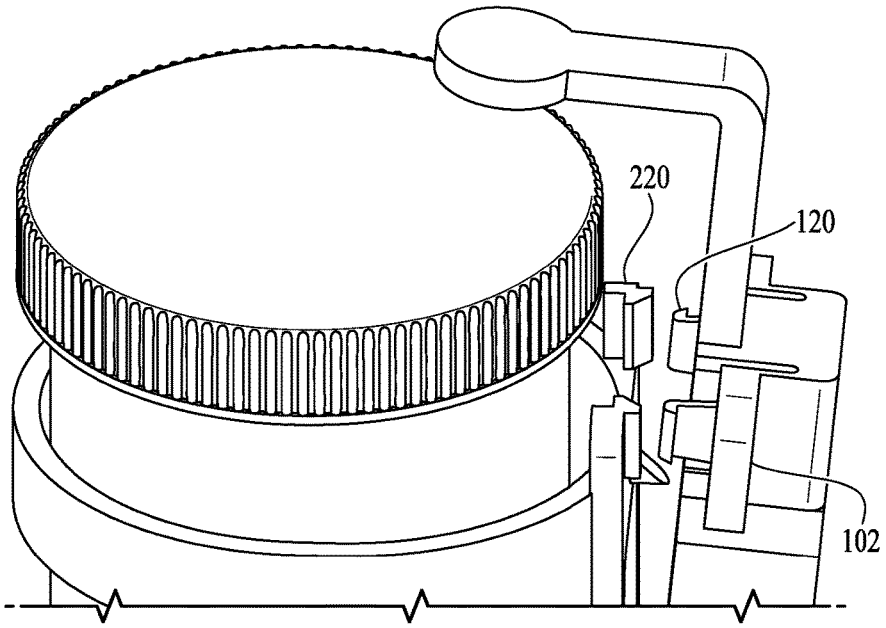
FIG. 13 is a top perspective view of the universal carriage in accordance with an embodiment of the present invention with the integrated timer pivoting to a vertical open position.

In a preferred embodiment as shown in FIG. 1, the integrated timer 100 has a pinch latch 102 located near the bottom of the lever 101 that serves to secure the integrated timer 100 to the carriage 200. The pinch latch 102 is shown in FIGS. 11-13. One skilled in the art could substitute the pinch latch 102 for any equivalent securing mechanism.

In addition, the timer 103 may be an electronic timer that includes a microprocessor, circuitry, a battery. In a preferred embodiment as shown in FIG. 1, the integrated timer 100 has an LCD screen 104 that displays information from the timer 103, such as the amount of time that has elapsed since the container 10 was last removed or opened. One skilled in the art could substitute the LCD screen 104 for any equivalent apparatus capable of displaying relevant information from the timer 103.

Figure 6:
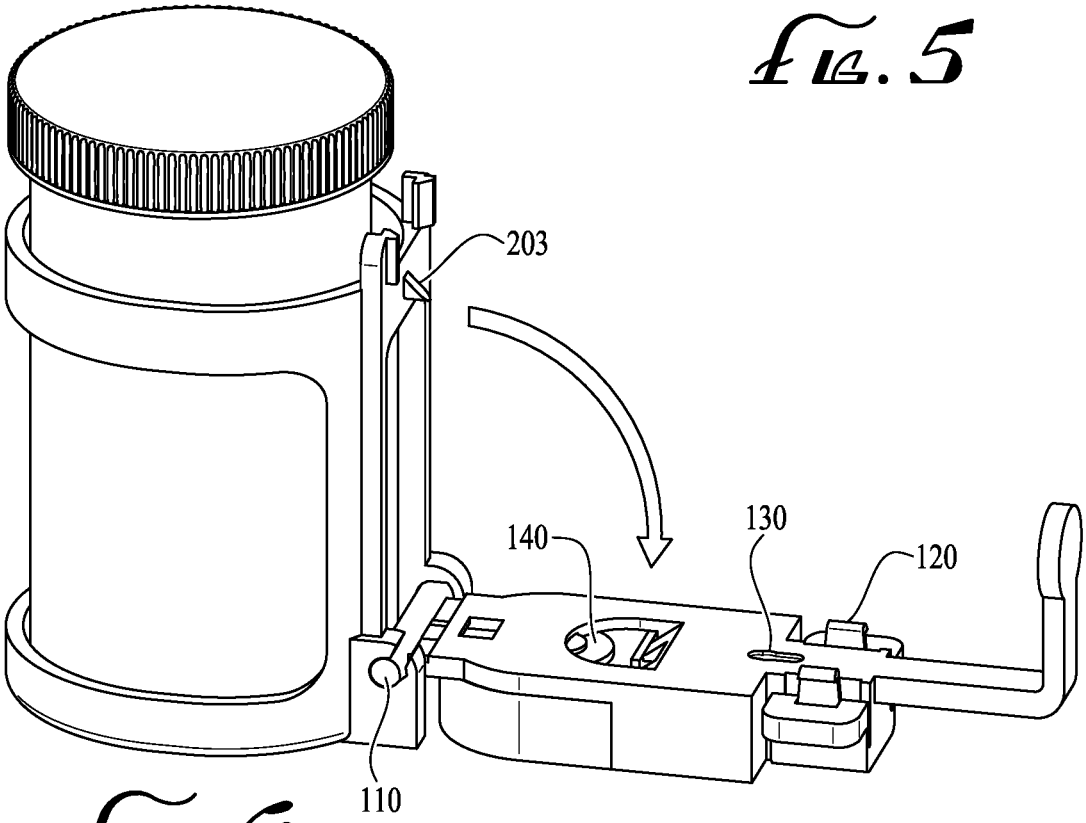
FIG. 6 is a side perspective view of the universal carriage in accordance with an embodiment of the present invention with the integrated timer in the horizontal position.

As shown best in FIG. 6, the integrated timer 100 has a pivot bar 110 which serves as a second mounting point to the carriage 200. The pivot bar 110 also allows the integrated timer 100 to pivot away from the carriage 200, in turn also pivoting the lever 101 away from the top of the container 10 to allow the container 10 to be removed from the carriage 200 or to be opened.

Figure 7:
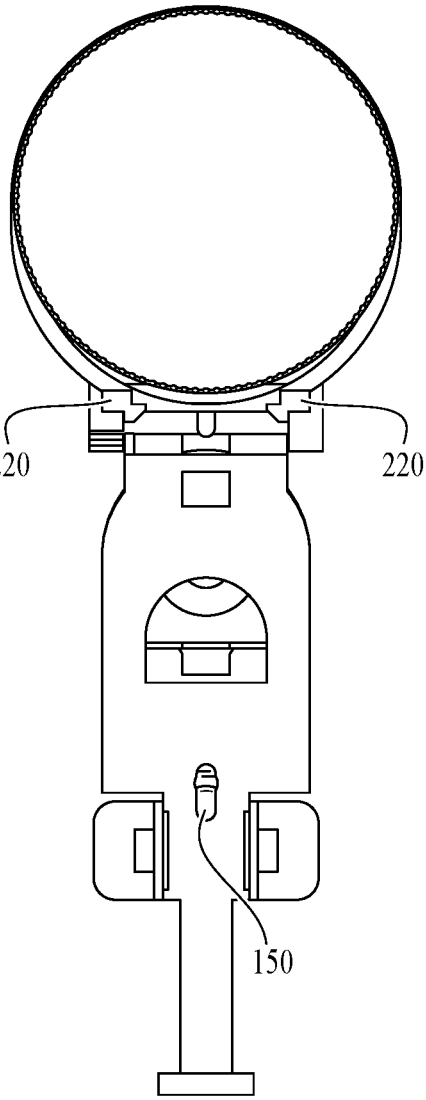
FIG. 7 is a top view of the universal carriage in accordance with an embodiment of the present invention with the integrated timer in the horizontal position.
Figure 8:
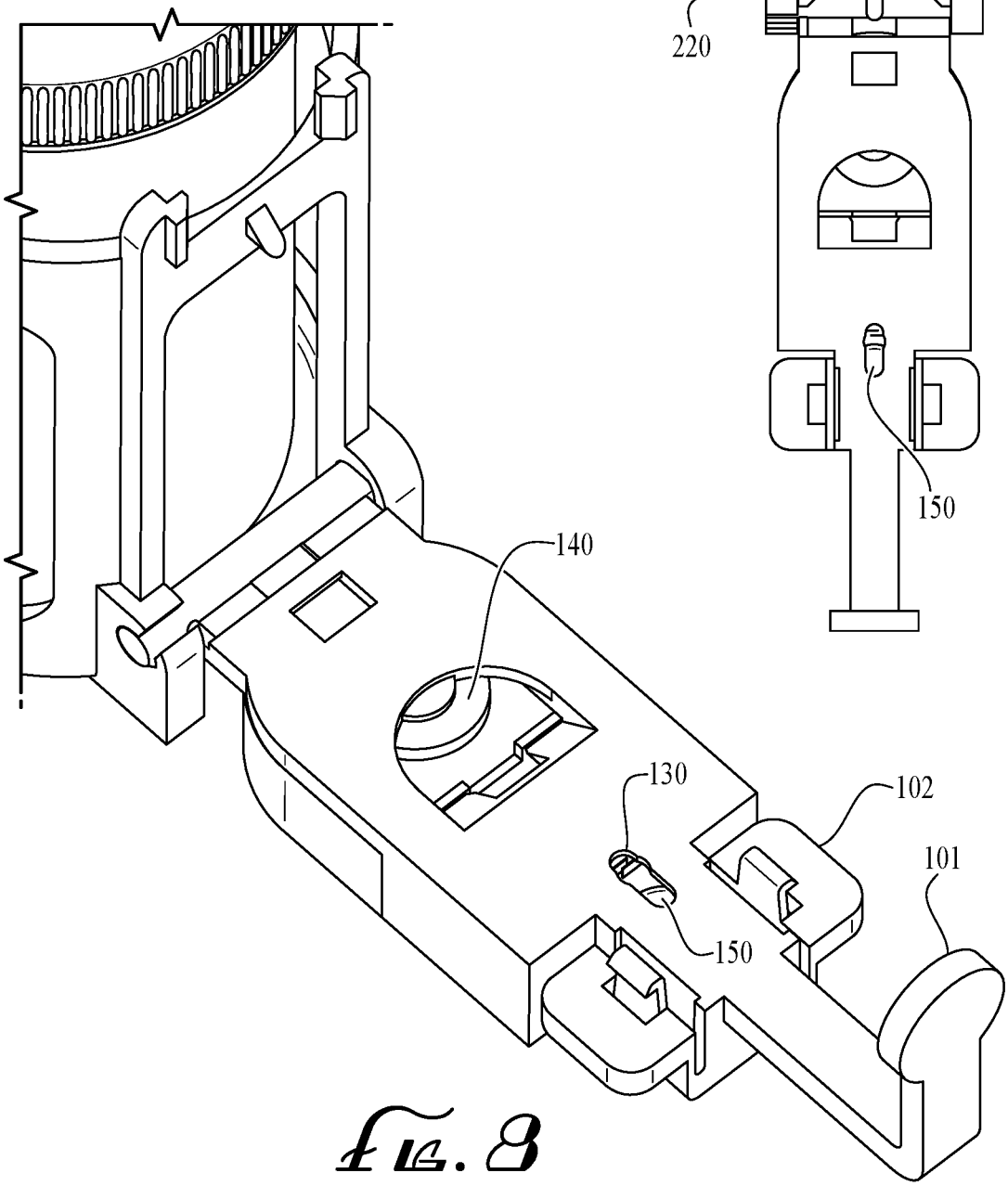
FIG. 8 is a top perspective view of the universal carriage in accordance with an embodiment of the present invention with the integrated timer in the horizontal position.

Also as shown in a preferred embodiment of FIG. 6, the integrated timer 100 has a battery 140 which serves as a power source for the timer 103. The integrated timer 100 also has a timer reset mechanism 170, which is comprised of a timer mechanism channel 130, gravity response member 150 (such as a ball bearing), and a timer reset switch 160. These components of the timer reset mechanism 170 may be located near the pinch latch 102. The pinch latch 102 further has latch arms 120, located behind the pinch latch 102, as shown best in FIGS. 7 and 8.

Figure 10:
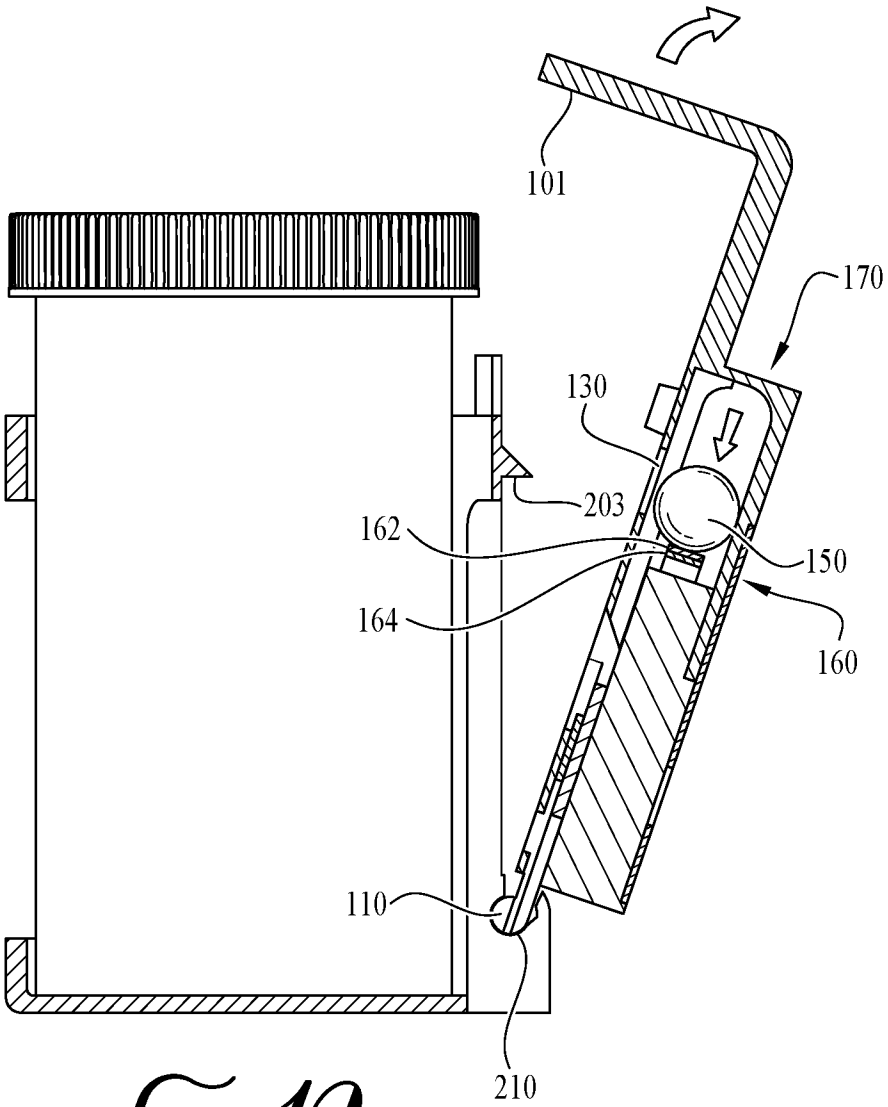
FIG. 10 is a cross section of the universal carriage in accordance with an embodiment of the present invention with the integrated timer pivoting to a vertical open position.
Figure 9:
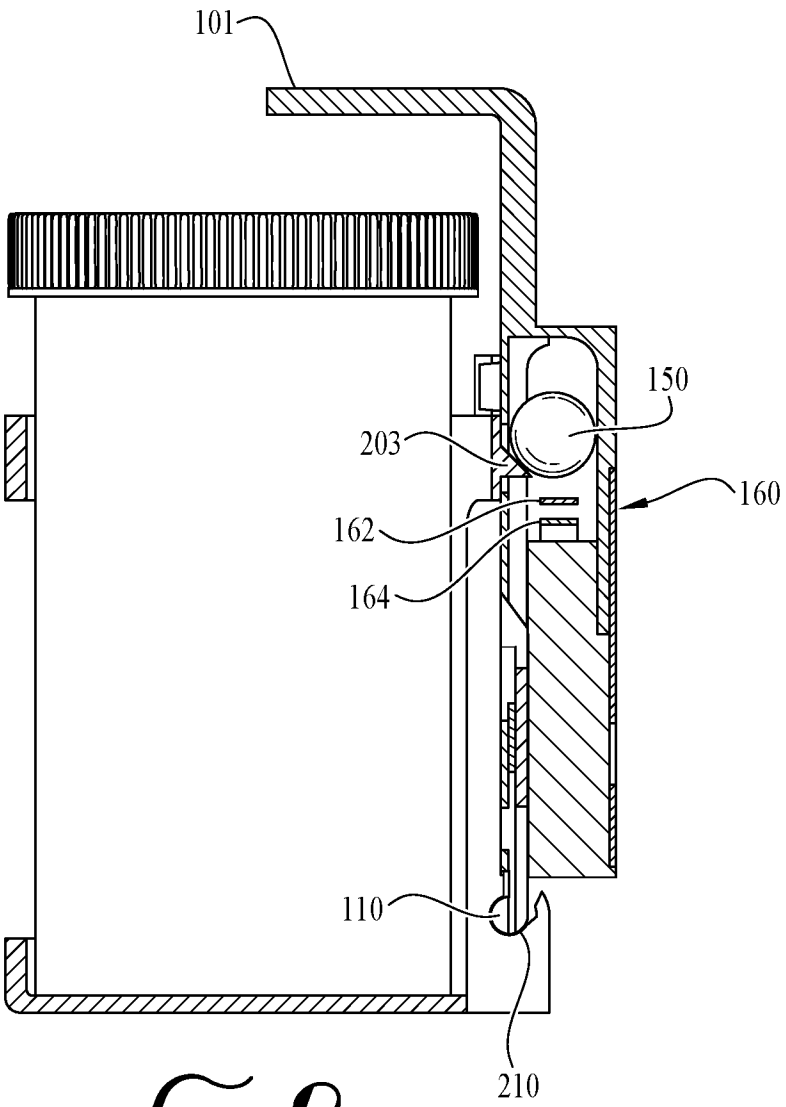
FIG. 9 is a cross section of the universal carriage in accordance with an embodiment of the present invention with the integrated timer in the vertical closed position.

As shown in FIGS. 9 and 10, the timer mechanism channel 130 is comprised of a housing having an inner bottom wall surface, and an inner peripheral wall surface that extends upwardly from a periphery of the inner bottom wall surface and that confines a channel therein, the channel having an upper region disposed above a lower region when the timer reset mechanism 170 is oriented in an upright direction.

Also as shown in FIGS. 9 and 10, the timer reset switch 160 is comprised of a first electric contact terminal 162 and a second electric contact terminal 164, where the first 162 and second 164 electric contact terminals are spaced apart from each other. In some embodiments, the first 162 and second 164 electric contact terminals are spring-loaded such that when they are pressed together with a force, the first 162 and second 164 electric contact terminals will return to a spaced apart position when the force is released.

In some embodiments, the timer reset switch 160 is positioned on the lower region of said timer mechanism channel 130 and the gravity response member 150 slides freely between the upper region and lower region of the timer mechanism channel 130 depending on the positioning the timer reset mechanism 170.

For example, As shown best in FIGS. 7 through 10, a preferred embodiment of the invention, the gravity response member 150 is contained within the timer mechanism channel 130. The timer mechanism channel 130 also includes a timer reset switch 160 on or near one end of the channel. The gravity response member 150 and timer reset switch 160 function in tandem to reset the timer 103 when the integrated timer 100 is pivoted away from the carriage 200 as more particularly described below.

Figure 3:
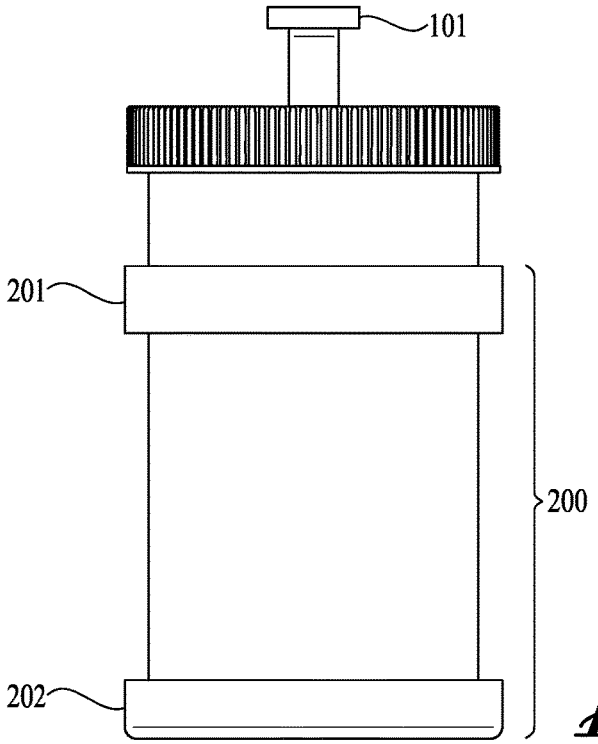
FIG. 3 is a front view of the universal carriage in accordance with an embodiment of the present invention.
Figure 4:
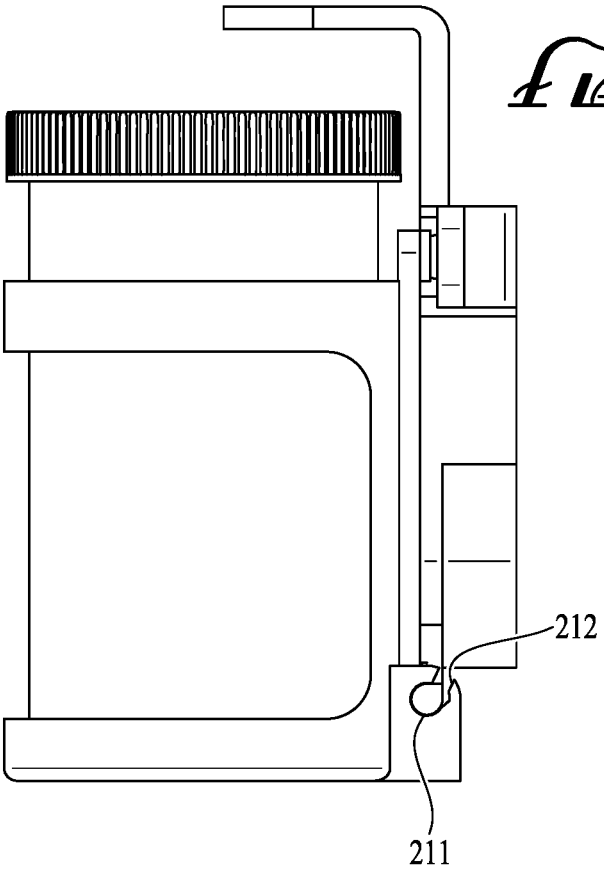
FIG. 4 is a side view of the universal carriage in accordance with an embodiment of the present invention.
Figure 5:
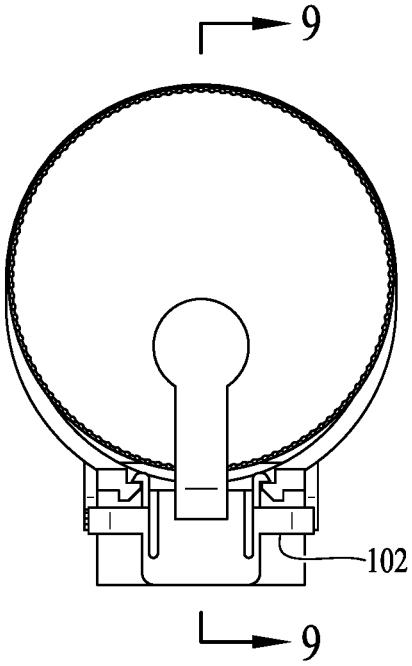
FIG. 5 is a top view of the universal carriage in accordance with an embodiment of the present invention.
Figure 19:
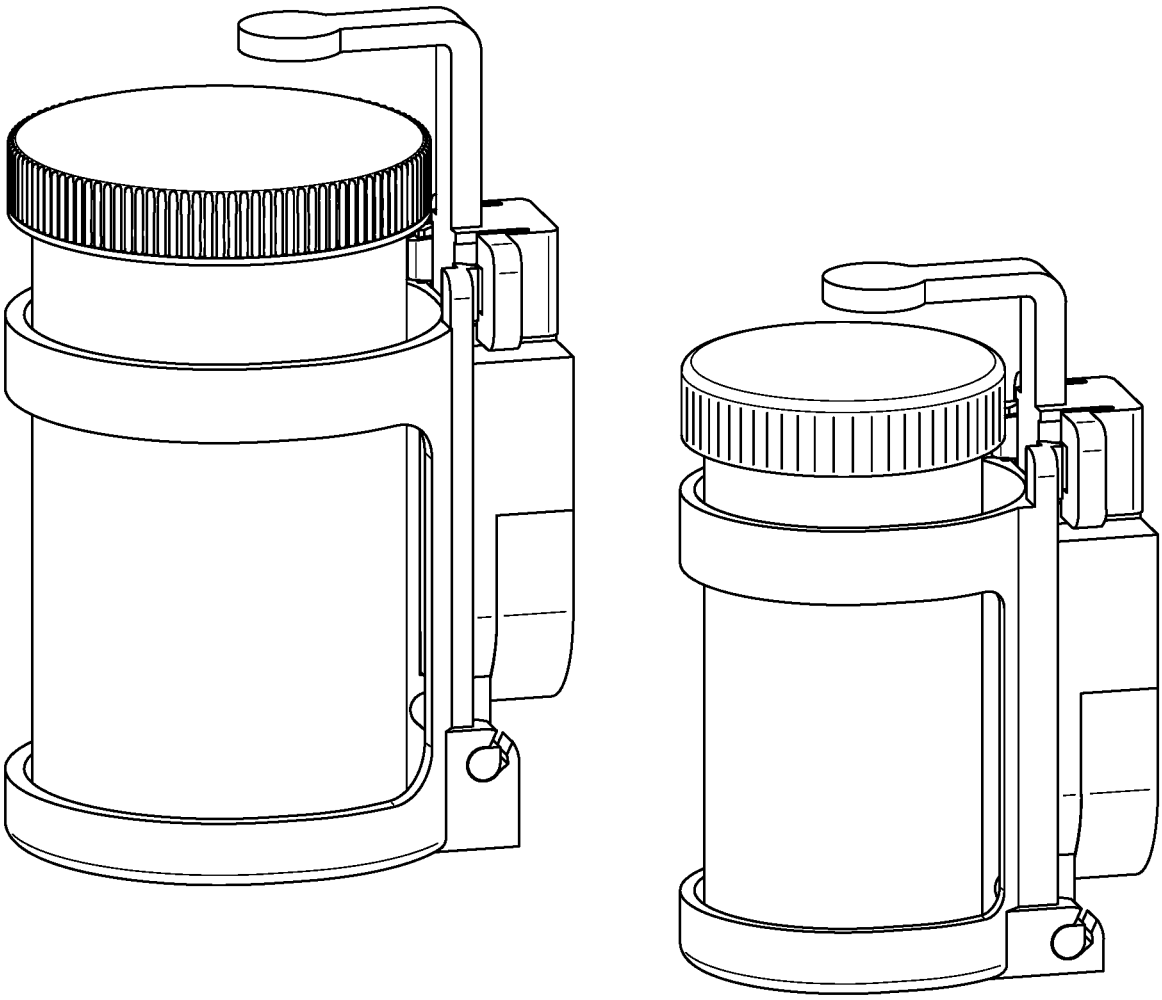
FIG. 19 includes perspective views of two universal carriages in accordance with embodiments of the present invention with different container sizes.

Referring to FIGS. 2 to 4, the carriage 200 is characterized by a top securing arm 201 and a bottom securing arm 202 that serves to secure the container 10 to the carriage 200. The negative space between the securing arms 201 and 202 allows viewing of the information (such as medication information) on the container's 10 label as best shown by FIG. 3. Securing arms 201 and 202 may be in different sizes and circumferences as shown in FIG. 19 to accommodate containers of different sizes. One skilled in the art may also implement securing arms 201 and 202 that are adjustable in size and circumference to adapt to containers of different sizes and shapes.

In a preferred embodiment as shown in FIGS. 2 and 6, the carriage 200 has apertures 210 and 211, which serve as a mounting point for the pivot bar 110 located at the bottom of the integrated timer 100. The aperture 211 has a notch 212 that allows for the separation of the integrated timer 100 from the carriage 200 as more particularly described below.

As best shown in in FIGS. 6-7 and 12-13, the carriage 200 has latch receiving arms 220, which receive the latch arms 120 to secure the integrated timer 100. The carriage 200 also has a timer reset notch 203 beneath the latch arms 120, which function to reset the timer 103 as more particularly described below.

C. General Description of the Operation of the Integrated Timer and Carriage

When the integrated timer 100 is in the vertical position (as show in in FIG. 1), the gravity response member 150 is not in contact with the timer reset switch 160 by default because the timer reset notch 203 is inserted into the timer mechanism channel 130 to separate the gravity response member 150 from the timer reset switch 160 (as shown in FIG. 9). When the gravity response member 150 is not in contact with the timer reset switch 160, the timer 103 will operate. For example, in a preferred embodiment, the timer 103 will count upwards by measuring hours and minutes (as displayed by an LCD screen 104) to track the last time the container 10 was removed from the carriage 200.

FIGS. 9 through 10 show the operation of the integrated timer 100 and carriage 200 to reset the timer 103. Particularly in FIG. 9, when the integrated timer 100 is pivoted away from the carriage 200 (with the pivot bar 110 as the pivot point), the integrated timer 100 changes from a vertical position (as show in in FIG. 1) to a horizontal position (as shown in in FIGS. 6 and 8).

When the integrated timer 100 is pivoted at a sufficient angle away from the carriage 200 (at or about 45 degrees from the central vertical axis of the carriage), the gravity response member 150 will move towards the timer reset switch 160. As shown in FIG. 10, the lever 101 will be pivoted away from the top of the container 10, allowing removal of the container 10 from the carriage 200 and/or opening of the container 10.

When the container 10 is removed and the contents of the container 10 are administered, the container 10 may be placed back into the carriage 200 and the integrated timer 100 is pivoted back to the vertical position as shown in in FIG. 1. When pivoting the integrated timer away from the carriage, the gravity response member 150 will thus be pulled by gravity toward the timer reset switch 160 (when the integrated timer 100 is at or about 45 degrees from the central vertical axis of the carriage 200). The timer 103 will be reset when the gravity response member 150 comes into contact with and actuates the timer reset switch 160 (shown in FIG. 10) and presses the electric contact terminals 162 and 164 together. The timer 103 will give an indication of time. For example, the timer 103 may display that the time is reset by showing the corresponding information on an LCD screen 104 (e.g., set back to "0"). As shown in FIG. 9, after the timer reset switch 160 is actuated, once the integrated timer 100 is returned to a vertical position, the gravity response member 150 will not be in contact with the timer reset switch 160 because the timer reset notch 203 will be inserted into the timer mechanism channel 130 to separate the gravity response member 150 from the timer reset switch 160. When the gravity response member 150 is separated from the timer reset switch 160 by the timer reset notch 203, the timer 103 will begin to operate normally again. In some embodiments, the timer 103 will count forward in time.

Thus, when the integrated timer 100 is pivoted back to the closed vertical position, the timer 103 will begin to run again until the timer is next reset when the container 10 is removed.

D. General Description of Securing the Integrated Timer to the Carriage

FIGS. 12 through 15 generally depict how the integrated timer 100 is secured to the carriage 200 in the vertical position using the pinch latch 102.

In a preferred embodiment, the pinch latch 102 is pinched on both sides by the user such that the latch arms 120 on the integrated timer 100 are no longer gripping the latch receiving arms 220 on the carriage 200. FIGS. 12 and 13 show the pinch latch 102 in the released position where the latch arms 120 are not secured to the latch receiving arms 220.

Figure 14:
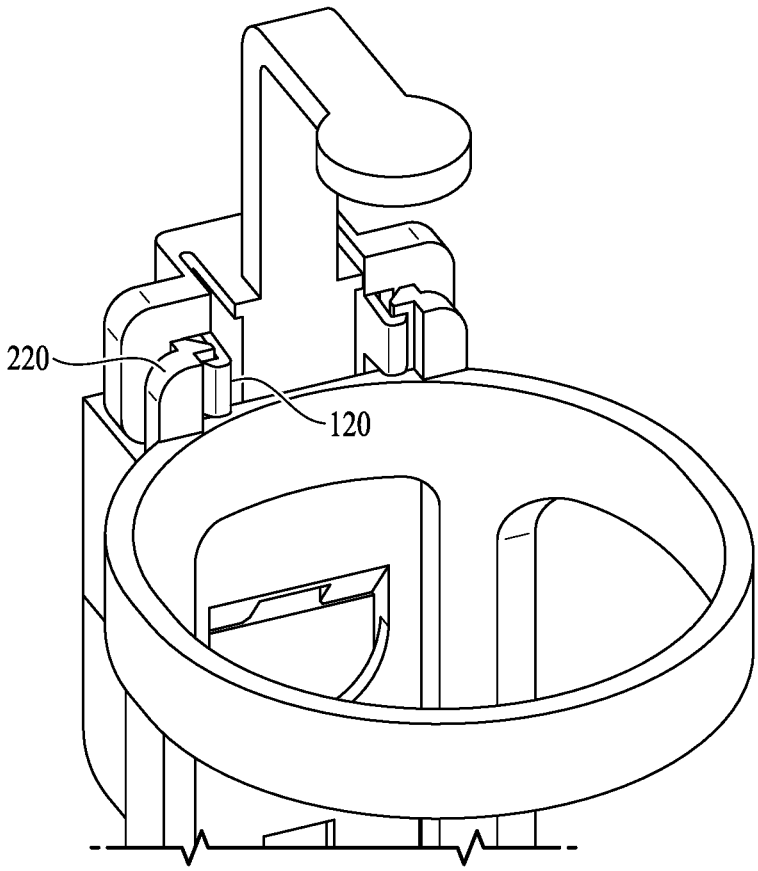
FIG. 14 is a front perspective view of the universal carriage in accordance with an embodiment of the present invention without the container in the closed position.
Figure 15:
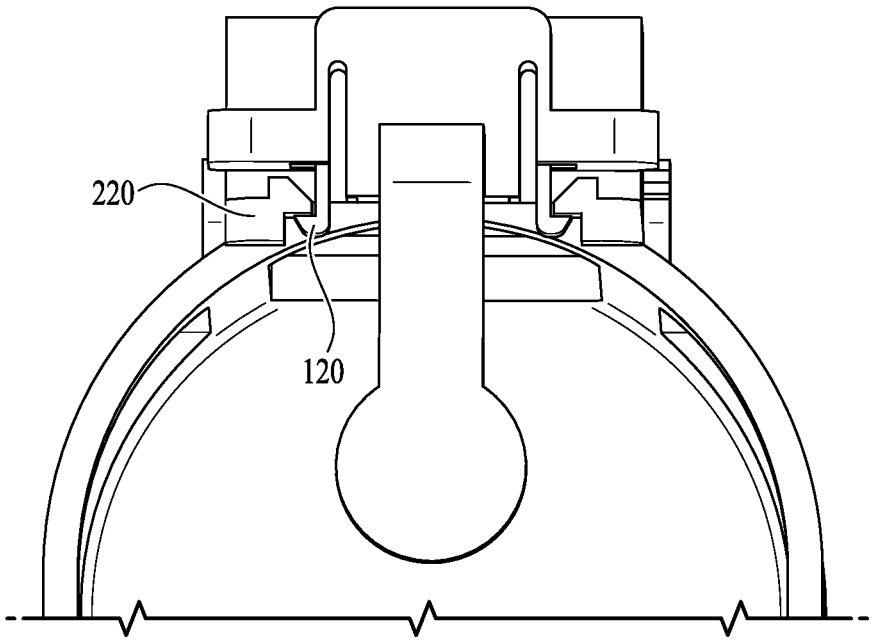
FIG. 15 is a top view of the universal carriage in accordance with an embodiment of the present invention without the container.

FIGS. 14 and 15 show the latch arms 120 on the integrated timer 100 secured to or gripping the latch receiving arms 220 on the carriage 200.

Figure 18:
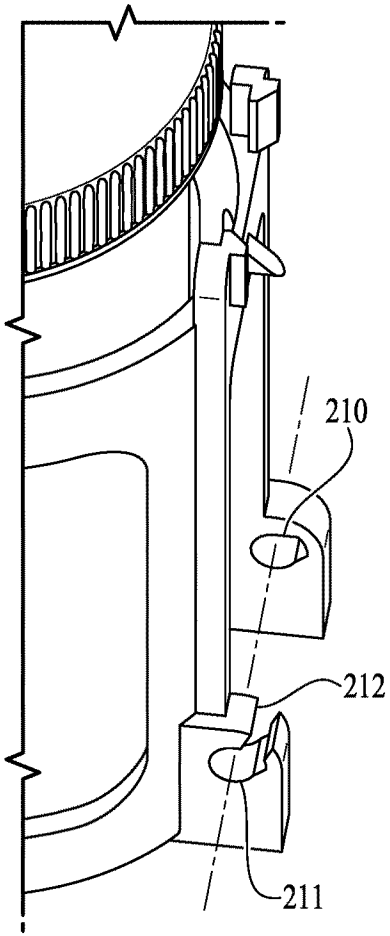
FIG. 18 is a side perspective view of the universal carriage in accordance with an embodiment of the present invention with the container and without the integrated timer.
Figure 17:
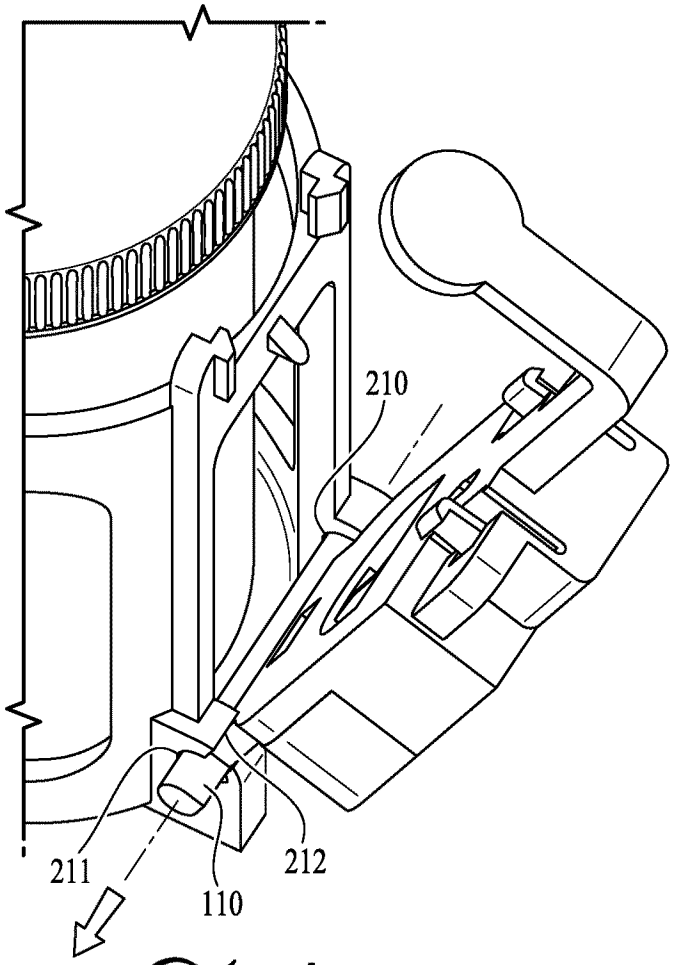
FIG. 17 is a side perspective view of the universal carriage in accordance with an embodiment of the present invention with the integrated timer in a pivoted position.
Figure 16:
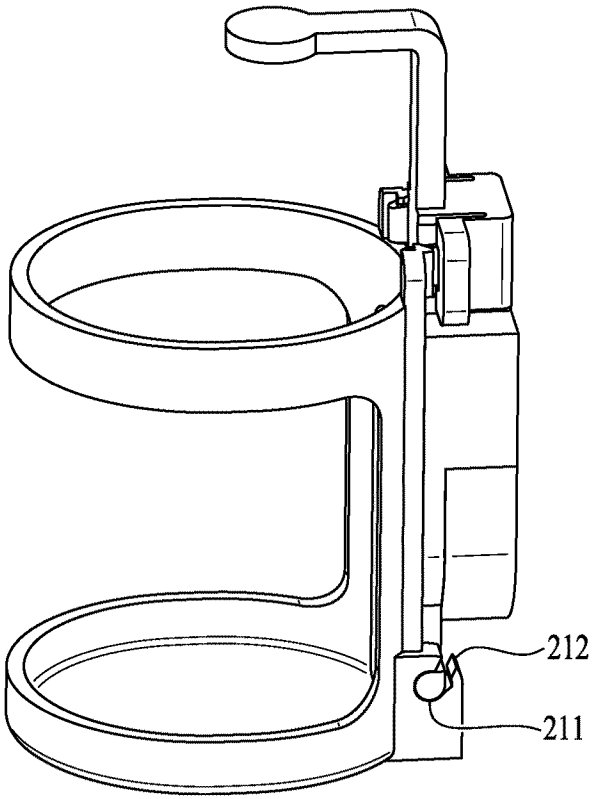
FIG. 16 is a side view of the universal carriage in accordance with an embodiment of the present invention without the container.

Additionally, the integrated timer 100 may be removed from one carriage 200 and transferred to another carriage 200. FIGS. 16 through 18 show the removal of the integrated timer 100 from the carriage 200.

As previously described, FIG. 16 shows a carriage 200 with apertures 210 and 211, which serve as a mounting point for the pivot bar 110 located at the bottom of the timing mechanism 100. The aperture 211 has a notch 212 that allows for the separation of the integrated timer 100 from the carriage 200.

FIG. 17 shows that the integrated timer 100 may be pivoted to a certain angle such that it lines up with the notch 212. The pivot bar 110 can then slide out from the apertures 210 and 211.

FIG. 18 show the carriage 200 with the integrated timer 100 removed. The integrated timer 100 may then be placed into a second carriage 200 of a different configuration and size, as shown in FIG. 20.

Figure 20:
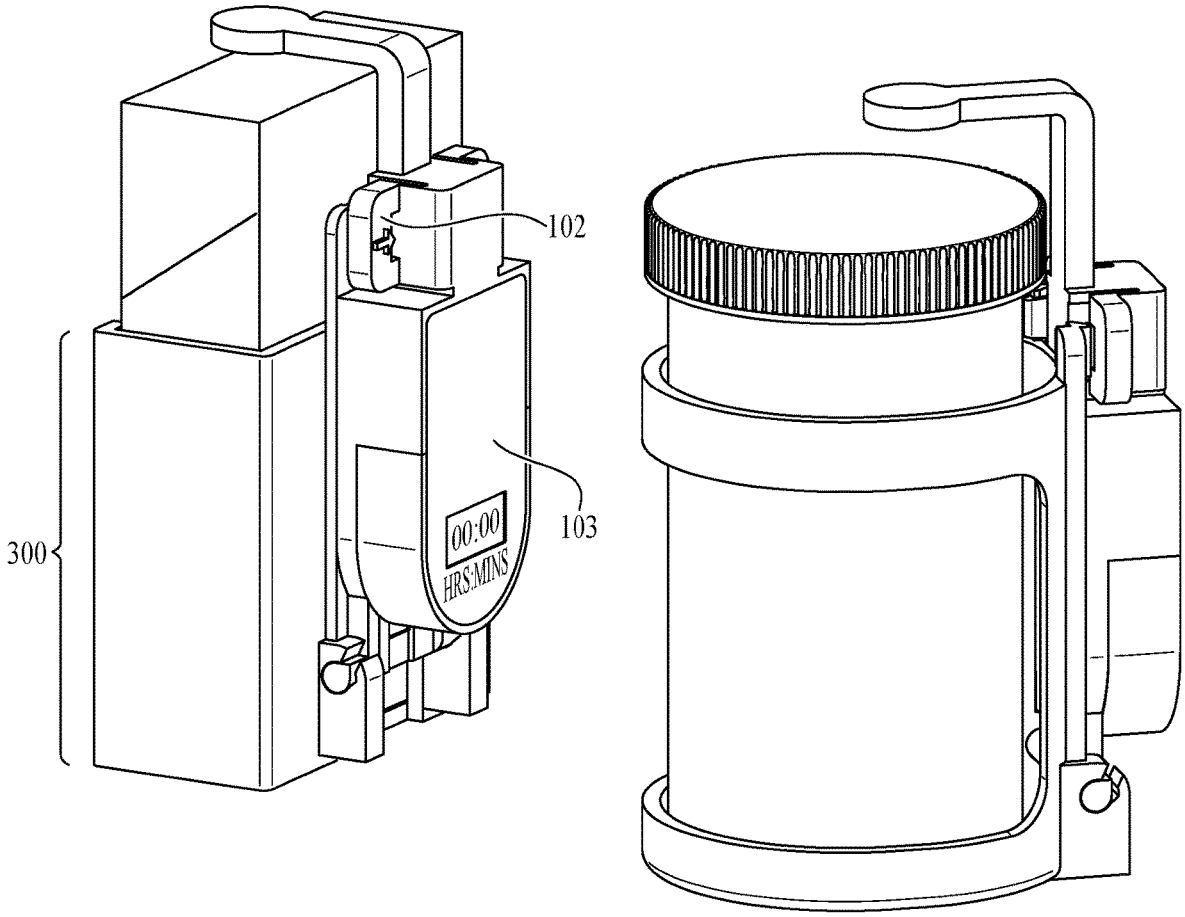
FIG. 20 includes perspective views of two universal carriages in accordance with embodiments of the present invention with different container sizes and shapes.
Figure 23:
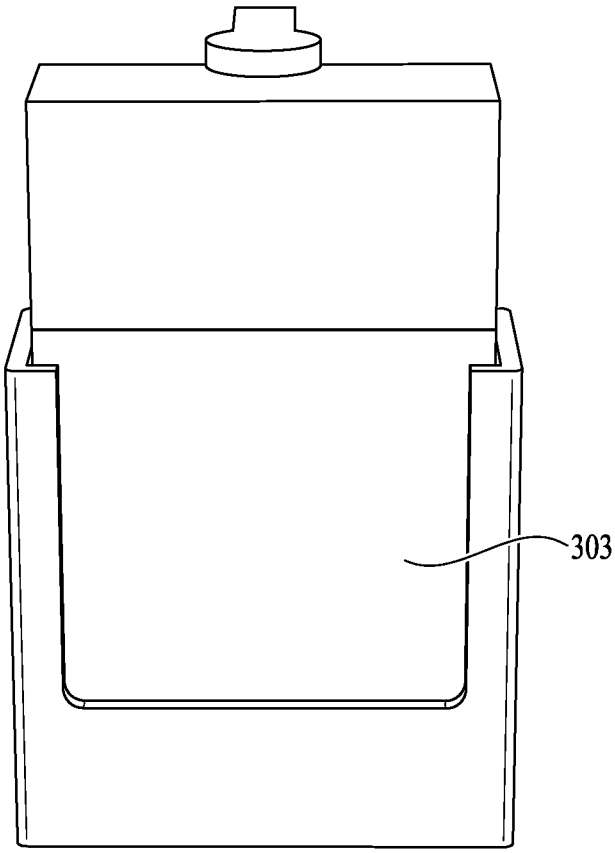
FIG. 23 is a front view of the universal carriage in accordance with an embodiment of the present invention with a rectangular carriage.
Figure 24:
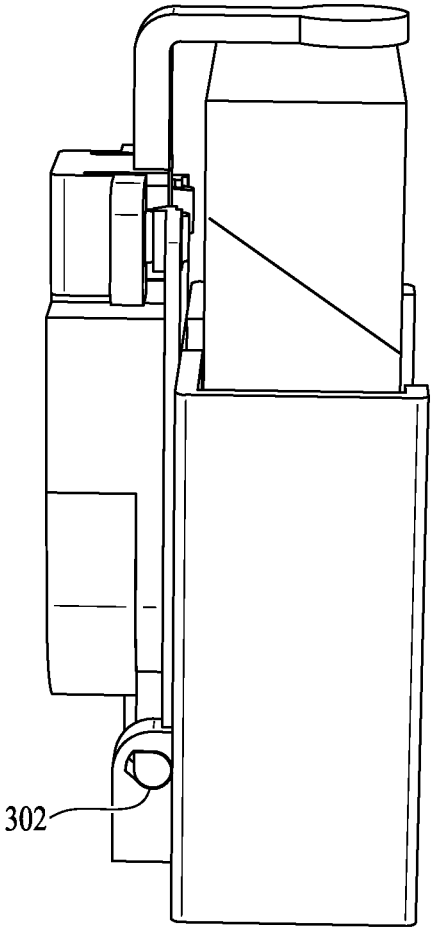
FIG. 24 is a side view of the universal carriage in accordance with an embodiment of the present invention with a rectangular carriage.

As shown in in FIG. 20, the integrated timer 100 may also be incorporated in a rectangular carriage 300. The rectangular carriage 300 will have apertures and 302 (shown in in FIG. 24) to hold the pivot bar 110 of the integrated timer 100. As shown in FIGS. 21 through 24, the integrated timer 100 will work in essentially the same manner as described above with the rectangular carriage 300. As shown in FIG. 23, the rectangular carriage 300 will also have an open area 303, allowing the user to view the label of the container in the rectangular carriage 300.

The advantage of using an integrated timer 100 with a carriage 200 means that containers of a particular shaped may be inserted universally into the invention. The universal carriage 1 will not be integrated into any specific container 10 and thus limited for the use of only one container 10.

Moreover, since the integrated timer 100 may be removed and placed on different carriages of different shapes or sizes (200 or 300), the invention may be adapted universally to containers of different shapes and sizes. Additionally, the securing arms 201 and 202 and the lever 101 may be adjusted in size or height to adapt to different container 10 sizes as described above.

While illustrative embodiments of the invention have been described in detail above, it is to be understood that the appended claims are intended to be construed to include variations of the present invention.

I claim:

1. An apparatus for holding a container, comprising:
a carriage for holding a container;
an integrated timer with at least two positions relative to the carriage, the integrated timer comprised of:
a lever; and
a timer;
a timer reset mechanism, wherein the timer reset mechanism is comprised of:
a timer mechanism channel,
a timer reset switch in the timer mechanism channel comprised of:
a first electrical contact terminal;
a second electric contact terminal; and
a gravity response member in the timer mechanism channel applying an actuation force to the timer reset switch, wherein the actuation force results from gravity acting on the gravity response member when the integrated timer is in a position tilted away from the carriage;
wherein when the integrated timer is in a vertical position relative to the carriage, the timer will start counting time;
wherein when the integrated timer is in a position tilted away from the carriage at an angle exceeding a predetermined actuation angle from the central vertical axis of the carriage, the timer reset mechanism will modify the time on the timer.

2. The apparatus of claim 1, wherein the first and second electric contact terminals are spaced apart from each other and the timer reset switch is actuated when the electric contact terminals contact each other.

3. The apparatus of claim 2, wherein at least one of the first and second electrical contact terminals is a spring-loaded electrical contact terminal.

4. The apparatus of claim 3, wherein the timer reset mechanism modifies the timer by resetting the time to a stored time.

5. The apparatus of claim 4, wherein the carriage is further comprised of a timer reset notch, wherein when the integrated timer is in a vertical position relative to the carriage, the timer reset notch is inserted into the timer mechanism channel to prevent said gravity response member from contacting the timer reset switch.

6. The apparatus of claim 5, wherein the gravity response member is a sphere made of a non-conductive material.

7. The apparatus of claim 6, wherein the integrated timer is further comprised of a pinch latch.

8. The apparatus of claim 7, wherein the carriage is further comprised of a plurality of pinch latch receiving arms.

9. The apparatus of claim 8, wherein when the integrated timer is in a vertical position relative to the carriage, the pinch latch secures the integrated timer to the carriage by attaching to the latch receiving arms such that the integrated timer cannot be moved from the vertical position unless the pinch latch is released from the latch receiving arms of said carriage.

10. The apparatus of claim 9, wherein the integrated timer is one integral component that is removably attached to the carriage.

11. An apparatus for holding a container, comprising:
a carriage for holding a container;
an integrated timer with at least two positions relative to the carriage, wherein said first position of said integrated timer is parallel to the vertical axis of the carriage and said second position of said integrated timer is such that said integrated timer is tilted at an angle exceeding a predetermined actuation angle from the vertical axis of the carriage;
a timer wherein when the integrated timer is in the first position, the timer will start counting forward;
a timer reset mechanism that is comprised of:
a timer mechanism channel,
a timer reset switch with a first electric contact terminal and a second electric contact terminal, wherein the first and second electric contact terminals are spaced apart from each other;
a gravity response member,
wherein when the said integrated timer is in the second position the gravity response member applies an actuation force to the first and second electric contact terminals, causing the first and second electric contact terminals to contact each other to reset the timer.

12. The apparatus of claim 11, wherein the carriage is further comprised of a timer reset notch wherein when the integrated timer is in the first position, the timer reset notch is inserted into the timer reset channel to prevent said gravity response member from contacting the timer reset switch.

13. The apparatus of claim 12, wherein while the integrated timer is in the first position, said container held in said carriage cannot be accessed or removed.

* * * * *